United States Patent [19]

Jonasson

[11] Patent Number: 4,570,447

[45] Date of Patent: Feb. 18, 1986

[54] REMOVING FROST DEPOSITS FROM COOLING-COIL BATTERIES IN A FREEZING PLANT DURING OPERATION

[75] Inventor: Staffan M. O. Jonasson, Helsingborg, Sweden

[73] Assignee: Frigoscandia Contracting AB, Helsingborg, Sweden

[21] Appl. No.: 523,528

[22] Filed: Aug. 16, 1983

Related U.S. Application Data

[63] Continuation-in-part of Ser. No. 39,246, May 15, 1979, Pat. No. 4,528,820.

[30] Foreign Application Priority Data

May 19, 1978 [SE] Sweden ..... 7895781

[51] Int. Cl.[4] ..... F25D 21/00

[52] U.S. Cl. ..... 62/80; 165/95; 15/316 R

[58] Field of Search ..... 165/95, 94; 62/80; 15/300 R, 316 R, 318, 319, 316 A

[56] References Cited

U.S. PATENT DOCUMENTS 1,978,555 10/1934 Snow ..... 165/95
2,634,659 4/1953 Jordanoff ..... 15/316

FOREIGN PATENT DOCUMENTS 23515 10/1949 Finland ..... 165/95
827909 5/1981 U.S.S.R. ..... 62/80

*Primary Examiner*—Henry Bennett
*Attorney, Agent, or Firm*—Sheridan Neimark; Karl W. Flocks

[57] ABSTRACT

A method of removing particulate or aggregate frost deposits from cooling-coil batteries or the like in a freezing plant during operation while maintaining the state of aggregation of the removed frost deposit, recurrently removing the frost deposits by a current of compressed air directed towards and brought to sweep over the cooling-coil batteries. The apparatus for carrying out the method includes at least one compressed-air nozzle which is adapted to be recurrently directed towards and brought to sweep over said cooling-coil batteries in order to blow away the frost deposit.

8 Claims, 7 Drawing Figures

REMOVING FROST DEPOSITS FROM COOLING-COIL BATTERIES IN A FREEZING PLANT DURING OPERATION

This is a continuation-in-part of co-pending application Ser. No. 039,246, filed May 15, 1979 now U.S. Pat. No. 4,528,820.

The present invention relates, on one hand, to a method of removing frost deposits from cooling-coil batteries or the like in a freezing plant during operation while maintaining the state of aggregation of the removed frost deposit, and, on the other hand, an apparatus for carrying out the method.

In cold-storage rooms and freezing plants, the air, which is circulated over the foodstuffs, is normally cooled by means of an air cooler. The air coolers used for this purpose usually consist of lamella type batteries or finned tubes. The air moisture causes formation of frost on the air cooler, which gradually diminishes the heat transmission coefficient and reduces the viability for air and, consequently, the cooling power. This makes it necessary to remove the frost deposits at certain intervals.

The frost normally forming at the low temperatures required for freezing or freeze-storing of products such as frozen foods will be very porous and have a low density. The reason is that the aqueous steam in the saturated air, even at a relative humidity of 100%, is very low in absolute value. In this connection, the frost crystals formed are small and attach porously on the cooling flanges of the cooling-coil battery as particulate or aggregate frost. However, this frost deposit is sufficient, as indicated above, to insulate the cold cooling battery surfact from the air and to prevent passage of the air through the cooling battery.

A hard crystalline ice-frost deposit arises if the frost is allowed to form over a long period and at varying temperatures. This type of frost will become hard and have a high density and is most similar to ice. Such ice-frost forms in home freezer compartments where the defrosing intervals perhaps may take half a year and where the start and stop of the compressor and the opening of the door or cover create constant temperature variations.

The 1949 Finnish Patent No. 23,515 discloses one attempted prior art method and apparatus for removing frost from cooling coils, in this case by scraping. However, this type of operation is highly unsatisfactory, as in the case of particulate frost deposits, the system is awkward and unwieldy, and, in addition, always carries with the the potential of physically damaging the cooling batteries. With regard to ice-frost, scraping systems such as shown in the Finnish Patent are almost totally useless, and if used to attempt to remove the ice-frost from the cooling battery constitutes a serious danger to the cooling coils.

The most common methods of removing frost deposits have all the disadvantage that the air cooler must be switched off and heated in order thereby to melt the frost. Among prior art methods to this effect there may be mentioned electrical resistance heating, "hot gas defrosting" (the flow of refrigerants being reversed in a suitable way so that the evaporator functions as a condenser during the defrosting operation) and water defrosting (the cooling-coil battery being heated with overflowing water). The disadvantages entailed with these defrosting methods reside in that the cooling-coil batteries as a rule must be switched off during the defrosting operation and that moisture forms around the cooling-coil batteries, which will soon result in new frost deposits. These defrosting methods also require considerable amounts of energy which substantially will be lost.

In addition to the defrosting methods described above there are methods of defrosting air coolers during operation by pouring a suitable chemical, e.g. a glycol/-water solution, on the air-cooler. However, these methods have the disadvantage that they are complicated, they require a certain equipment for distilling away the melted frost and they require special arrangements to prevent the chemical splashing onto the foodstuff in the form of drops.

A primary object of the present invention is to provide, while avoiding the above-mentioned disadvantages, a method of removing the particulate or aggregate type of frost deposits from cooling-coil batteries or the like in a freezing plant during operation, while maintaining the state of aggregation of the removed frost deposits, and an apparatus for carrying out the method, which is of simple and reliable construction and function.

This object is realized by the present invention according to which the method of removing the deposits of frost from cooling-coils or the like during operation is characterized in that the frost deposit is recurrently removed by a current of compressed air being directed towards, and brought to sweep over the cooling-coil batteries, and the apparatus for carrying out the method is characterized in that it comprises at least one compressed-air nozzle which is adapted to be recurrently directed towards and brought to sweep over the cooling-coil batteries in order to blow away the frost deposit from the cooling-coil batteries by means of a current of compressed air.

While the present invention does not entirely eliminate the need for total defrosting by heating of the cooling battery in view of the fact that it is hardly possible in practice to remove ice-frost without using heat, it does nevertheless significantly reduce the frequency of such defrostings using heat. Practical experience using the system of the present invention has shown that the working period between heat defrostings increased from about three hours to about seven hours when the system of the present invention was put into use, thereby providing a more than doubling of the working period of the freezer without the necessity of heat defrosting. Additional experience has shown that the present system prolongs the intervals between heat defrostings by factors of 2–4.

In more detail, the present system comprises a series of air nozzles through which are passed supersonic compressed air which blasts away the frost build-up as such nozzles travel automatically back and forth across the coils. The simplicity of the mechanism assures reliable operation. There is no energy-consuming heating involved nor is there large water consumption for frost melting. Fan power consumption is also reduced due to the fact that the coils are kept substantially free from frost thus reducing the workload of the fans. The system works parallel to the freezer operation and allows full production for longer periods increasing the production efficiency and giving a better utilization of the capital investment In addition, the system will handle a wide range of operating conditions involving different types of products, infeed temperatures, product moisture contents, etc.

The invention will be described in greater detail hereinafter with reference to the accompanying drawing which illustrates preferred embodiments and in which:

FIG. 1 is a side elevation of a first embodiment of an apparatus according to the invention for removing frost deposits from cooling-coil batteries or the like;

Figure 2:
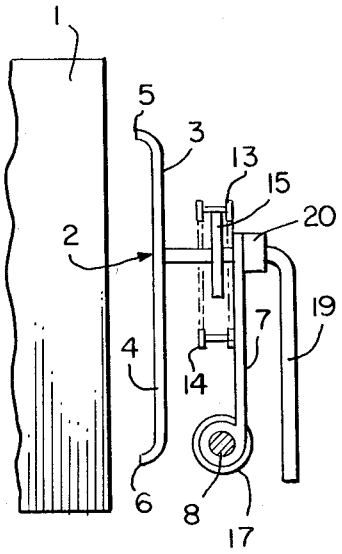
FIG. 2 is a sectional view on line II—II of FIG. 1.
Figure 1:
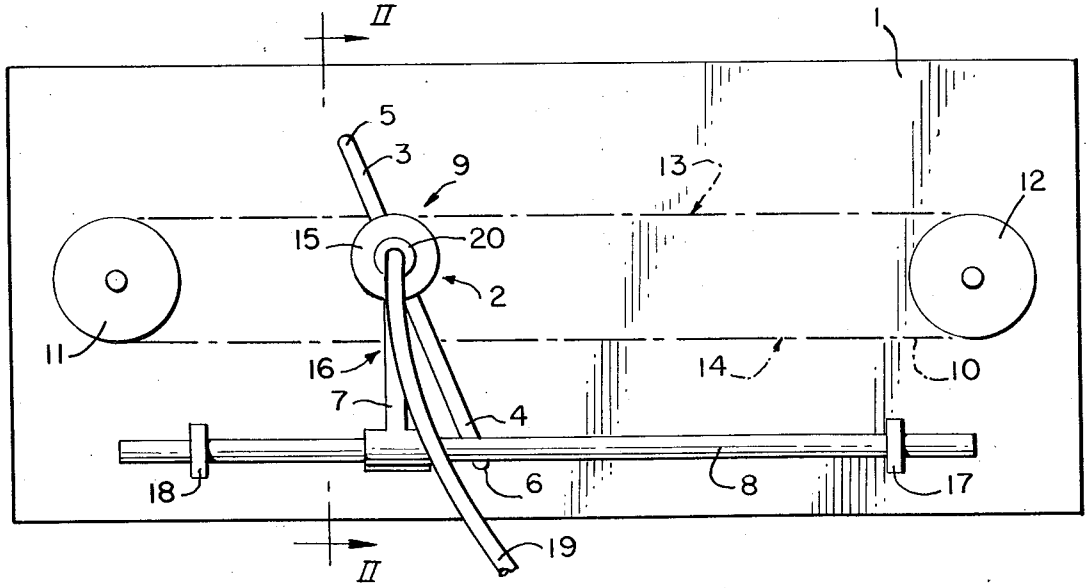

FIG. 1 shows schematically a cooling-coil battery 1 and a defrosting apparatus according to the invention designed to blow away frost deposits from the cooling-coil battery by means of compressed air. The apparatus includes a nozzle means 2 which, according to a preferred embodiment, consists of two oppositely directed pipes 3, 4 of different length, which are bent at their free ends so that their mouths 5 and 6 are directed towards the cooling-coil battery, a support 7 at one end of which the nozzle means is rotatably mounted in the vertical plane and the other end of which is mounted to slide on a rail 8 extending longitudinally of the cooling-coil battery, and a driving means 9 adapted to reciprocate the nozzle means 2 longitudinally of the cooling-coil battery during rotation of the nozzle means.

The driving means 9 includes an endless chain 10 which is passed over two chain wheels 11, 12 and the upper and lower parts 13 and 14 of which are generally parallel with the rail 8, and a chain wheel 15 which is fixedly secured to the nozzle means 2.

The chain wheel 15 is adapted to mesh with the upper part 13 of the chain 10 and the support 7 is fixedly connected, at 16, to the lower part 14 of the chain 10.

If the chain 10 is driven in such a way that the upper part 13 moves to the left relative to the drawing and the lower part 14 consequently moves to the right relative to the drawing, then the support 7 will be displaced to the right while the nozzle means 2 will rotate in anticlockwise direction due to the chain wheel 15 being in mesh with the upper part 13. When the support abuts a stop 17, which is provided on the rail 8 before the chain wheel 12, the chain 10 will change direction of travel and the nozzle means will move to the left while effecting a rotational movement in clockwise direction until the support abuts a stop 18 where the chain changes its direction of travel again. Consequently,the nozzle means can be reciprocated along the cooling-coil battery 1 until this is defrosted.

As the mouths 5 and 6 of the nozzle means 2 are situated at different distances and in different directions relative to the center of the chain wheel 15, the compressed-air jets directed towards the cooling-coil battery will follow different paths during the defrosting process, whereby a larger zone of the cooling-coil battery is exposed to said jets. It is of course possible within the scope of the invention to arrange a larger or smaller number of mouths on the nozzle means.

The compressed air is supplied to the nozzle means 2 from a flexible conduit 19 which is in communication with the nozzle means via a swivel connection 20.

To obtain better efficiency in blowing away the frost deposits one may incorporate with the apparatus of the invention a means causing the compressed-air jet directed towards the cooling-coil battery to pulsate. This means produces a percussion effect on the frost deposit, which facilitates and accelerates loosening.

As the principal object of the invention is to remove frost deposits during operat on, the apparatus the invention is allowed to work at intervals. It is important, however, that the period of time between these intervals is not too long so that the apparatus fails to remove the frost deposits being formed in the meantime.

If so required in order to prevent the components of the defrosting apparatus from freezing fast or the nozzle from being clogged by freezing, the system is provided with electric heating, e.g. a heating cable.

The driving unit is preferably operated by means of a separate motor which is connected either to one of the chain wheels 11, 12 and 15 or to the support 7 which may include e.g. a gear reduction set in which the rail 8 is the rack.

An alternative way of reciprocating the nozzle means along the cooling-coil battery resides in that the reaction power of the compressed air flowing out from the mouths causes the nozzle means to rotate. According to this particular embodiment the mouths of the nozzle means should be orientable at different angles to the side of the cooling-coil battery so that the angles of said mouths relative to said side are changed when the nozzle means abuts the stops 17 and 18, at which moment the nozzle means starts rotating in the opposite direction.

It is also possible within the scope of the present invention to moVe the nozzle means in other ways along the cooling-coil battery. In this connection, however, it is important that the current of compressed air directed towards the cooling coil battery should cover the battery to an extent such that all frost deposits will be blown away therefrom.

It should be pointed out, howver, that the most characteristic feature of the invention resides in that the frost deposit is recurrently removed from the cooling-coil batteries through mechanical action while maintaining the state of aggregation of the removed frost deposit.

It is easily understood that the apparatus of the invention may be secured to a stand (not shown), whereby the entire apparatus may be moved from a cooling-coil battery to another.

Figure 3:
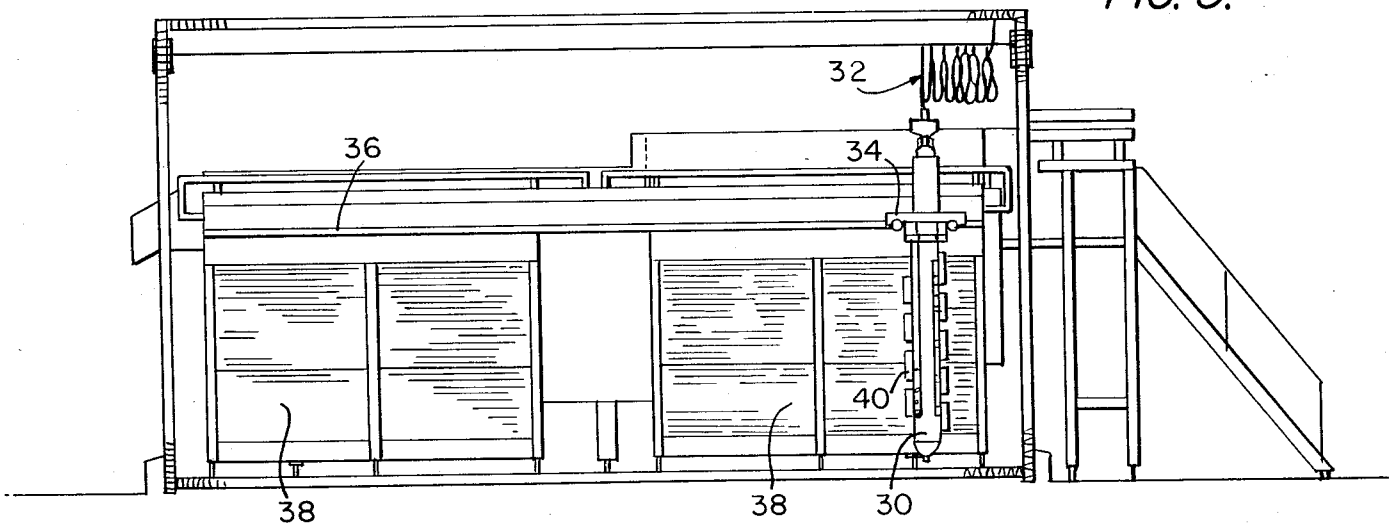
FIG. 3 is a side elevation of a second and preferred embodiment of an apparatus according to the invention.

Another, and more preferred, embodiment is generally shown in FIG. 3 and includes a compressed air tank 30 and drive and air inlet means 32. The tank is supported on a wheeled carriage 34 or the like which moves on suitable tracks or rails 36. Accordingly, it can be seen that the tank 30 is vertically mounted and travels on the carriage 34 so that it can move back and forth along the front surface of the cooling battery, shown generally at 38.

Figure 4:
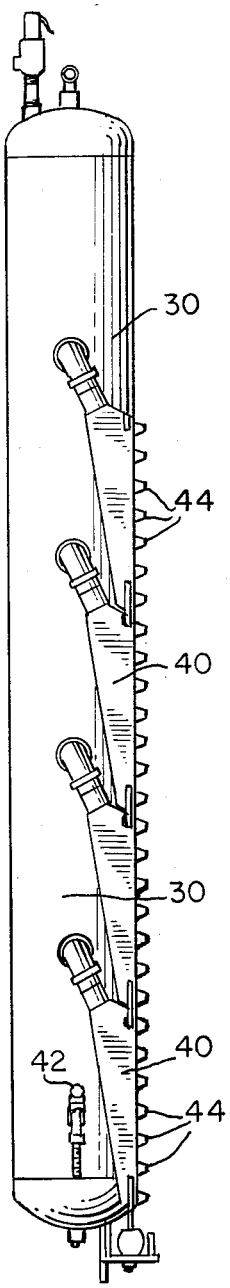
FIG. 4 is a detailed view of a compressed air tank as shown in the embodiment of FIG. 3.
Figure 5:
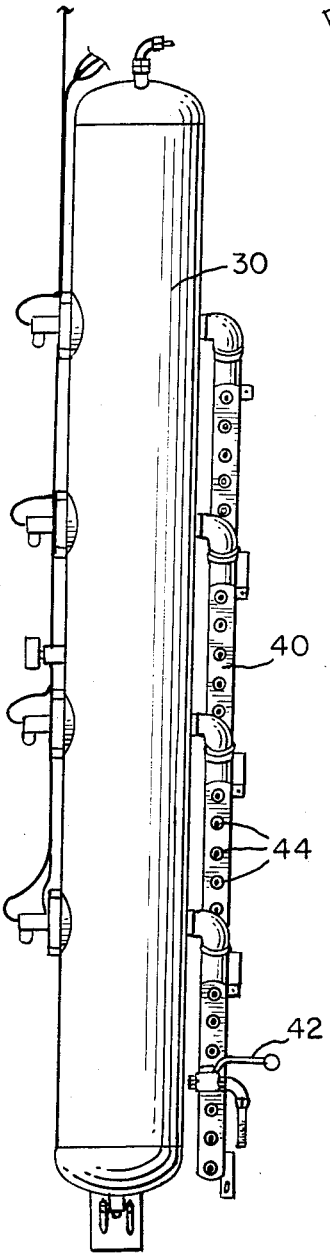
FIG. 5 is another view of the tank rotated 90° from the view in FIG. 4.
Figure 6:
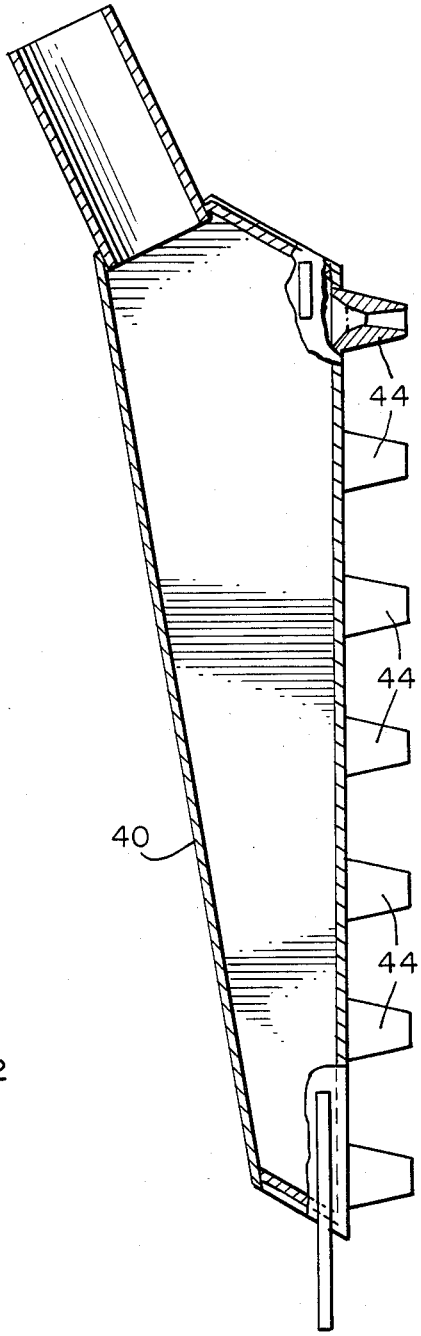
FIG. 6 is an enlarged view of an air nozzle header and a series of nozzles shown in FIG. 4.

The tank 30 is shown in more detail in FIGS. 4 and 5. Such tank 30 is mounted in direct connection with a ball valve 42 and with a series of nozzle header means for expansion elements 40, each of the headers 40 having a series of nozzles 44 as best seen in FIG. 6. The aforementioned direct connection serves to give a minimum pressure loss at the nozzles 44. Such nozzles 44 are so mounted that they will blow between the tubes in the cooling battery so that the air jet reaches far into the cooling battery.

Figure 7:
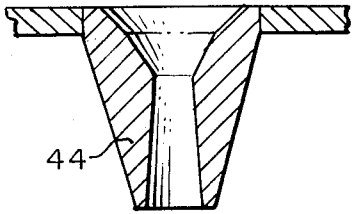
FIG. 7 is a detailed view of a nozzle.

As compressed air is blown through all the nozzles at the same time, the effect is greater than if only one nozzle is used. As best seen in FIG. 7, the nozzles 44 have a particular configuration which produce supersonic speed during blowing. In one form of operation, when the tank moves in one direction the first and third nozzles blow alternately and in the return direction the second and fourth nozzles blow alternately. In this way, the entire cooling-coil battery is uniformly covered. Under such circumstances, the blowing times may be on the order of 0.2 seconds with intervals of approximately 6 seconds, and such intervals may be controlled by automatic means.

The valves which control the interval of blowing, are preferably of the diaphragm type and are integrated in the tank 30. The valves are desirably constructed to open totally in a very short time and to close totally in the same short time. Such a construction serves to effect efficient blowing without consuming an unnecessarily large amount of compressed air. In addition, a diaphragm-controlled main valve is provided which in turn is operated by a magnetic pilot valve.

The air supply to the tank may be carried out through the hose 32. However, the air is preferably dried in an absorption dryer to a dew point lower than the air temperature in the freezer. Otherwise, there is a risk of the valves and nozzles being clogged by frost.

According to another alternative, a compressor may be mounted in direct connection to the carriage on which the tank 30 travels. In this embodiment, no hose connection is required because the compressor and the tank move as a unit. Instead, there is needed a flexible cable to the compressor motor and the pilot valves. This alternative embodiment has the advantage that the air need not be dried because the compressor absorbs air of low temperature, i.e. the air already contains a low absolute humidity. As the air after the compressor will have a considerably higher temperature, the humidity can be carried in the air without condensing and thus producing any undesirable blocking of the valves.

It will be obvious to those skilled in the art that various changes may be made without departing from the scope of the invention and therefore the invention is not limited to what is shown in the drawings and described in the Specification but only as indicated in the appended claims.

What is claimed is:

1. Apparatus for recurrently removing frost deposits from cooling-coil batteries or the like in a freezing plant during operation, while the state of aggregation of the removed frost deposit is maintained, comprising a plurality of compressed-air nozzles and means supporting said nozzles for imparting reciprocating motion to said nozzles longitudinally of the cooling-coil batteries and including a movable carriage which travels along a rail or track mounted adjacent said cooling-coil batteries, and means for furnishing to said nozzles compressed air of such pressure and temperature as to blow frost deposits from the cooling-coil batteries without melting such frost.

2. Apparatus according to claim 1, wherein said means for furnishing compressed air to said nozzles is mounted on said carriage.

3. Apparatus according to claim 2, wherein said means for furnishing compressed air to said nozzles comprises a compressed air tank.

4. Apparatus according to claim 1, wherein said means for furnishing compressed air to said nozzles comprises a compressed air tank.

5. Apparatus according to claim 3 further comprising an air inlet hose means for feeding compressed air to said compressed air tank.

6. Apparatus according to claim 3 further comprising a series of air distribution headers mounted on said compressed air tank, each said header having a series of said nozzles mounted thereon for passage of pressurized air from said tank through said headers and out of said nozzles.

7. Apparatus according to claim 6, wherein said nozzles are mounted on said headers in relation to said cooling-coil batteries that the nozzles direct pressurized air between the coils.

8. Apparatus according to claim 6 further comprising valve means to control the blowing times with intervals therebetween.

* * * * *